US006623237B2

(12) United States Patent
Harris et al.

(10) Patent No.: US 6,623,237 B2
(45) **Date of Patent: *Sep. 23, 2003**

(54) WEAR RESISTANT FUEL PUMP

(75) Inventors: David Edward Harris, Birch Run, MI (US); John Gardner Fischer, Goodrich, MI (US)

(73) Assignee: Delphi Technologies, Inc., Troy, MI (US)

( * ) Notice: Subject to any disclaimer, the term of this patent is extended or adjusted under 35 U.S.C. 154(b) by 41 days.

This patent is subject to a terminal disclaimer.

(21) Appl. No.: 09/934,152

(22) Filed: Aug. 21, 2001

(65) Prior Publication Data

US 2003/0039539 A1 Feb. 27, 2003

(51) Int. Cl.[7] ..... F04D 5/00

(52) U.S. Cl. ..... 415/55.1; 415/200; 416/229 R; 416/241 A; 416/241 B

(58) Field of Search ..... 415/55.1, 200; 416/229 R, 241 A, 241 B; 417/423.1, 423.14, 423.4

(56) References Cited

U.S. PATENT DOCUMENTS 5,383,979 A * 1/1995 Schneider ..... 148/217
6,095,771 A 8/2000 Schelhas et al.
6,402,460 B1 * 6/2002 Fischer et al. ..... 415/55.1
6,435,810 B1 * 8/2002 Fischer et al. ..... 415/55.1

FOREIGN PATENT DOCUMENTS

| | | |
|---|---|---|
| EP | 1 199 477 A2 | 4/2002 |
| EP | 1 207 296 A1 | 5/2002 |
| JP | 57171093 | 10/1982 |
| JP | 09112489 | 5/1997 |

OTHER PUBLICATIONS

European Search Report for European 02078041.7 dated Nov. 6, 2002.

* cited by examiner

*Primary Examiner*—Edward K. Look
*Assistant Examiner*—Richard A. Edgar
(74) *Attorney, Agent, or Firm*—Jimmy L. Funke

(57) ABSTRACT

A wear resistant fuel pump for a vehicle includes a pump section having a rotatable impeller and a plurality of plates disposed axially adjacent to and cooperating with the impeller to pump fuel therethrough. The wear resistant fuel pump also includes a motor section disposed adjacent the pump section and having a motor to rotate the impeller. The wear resistant fuel pump further includes an outlet section disposed adjacent the motor section to allow pumped fuel to exit therethrough. The impeller is made of a first compound and the plates are made of a second compound having an abrasion wear resistance on a surface thereof that improves abrasion wear characteristics therebetween.

20 Claims, 2 Drawing Sheets

WEAR RESISTANT FUEL PUMP

TECHNICAL FIELD

The present invention relates generally to fuel pumps for vehicles and, more particularly, to a wear resistant fuel pump for a vehicle.

BACKGROUND OF THE INVENTION

This invention is related to co-pending and commonly assigned U.S. Ser. No. 09/629,688.

It is known to provide a fuel tank in a vehicle to hold fuel to be used by an engine of the vehicle. It is also known to provide a fuel pump to pump fuel from the fuel tank to the engine. One type of fuel pump is known as a high-pressure turbine fuel pump. The high-pressure turbine fuel pump typically includes an impeller rotatable between plates made out of materials that are as hard or harder than contaminants in fuel such as dirt/sand. Such materials include ceramic, hardened steel, and anodized aluminum. While such materials for the impeller and plates provide for a hard abrasion wear resistant surface, they require a very costly process to make the plates and impeller due to complicated shapes and tight tolerances.

Improved geometry including complicated shapes and tight tolerances can be obtained using injection or compression molded plastic plates. However, plastic plates are susceptible to high amounts of wear when operating in fuels with high levels of dirt/sand contamination. The contamination material is harder than the plastic material for the plates and impeller, and thus the plastic plates and impeller are easily worn away by the contamination due to poor abrasion wear resistance, resulting in a reduction of fluid flow output and causing loss of pump performance.

Therefore, it is desirable to improve the abrasive wear characteristics of a fuel pump for a vehicle. It is also desirable to provide a wear resistant fuel pump for a vehicle. It is further desirable to provide a wear resistant pump section for a fuel pump of a vehicle.

SUMMARY OF THE INVENTION

It is, therefore, one object of the present invention to provide a wear resistant fuel pump for a vehicle.

It is another object of the present invention to provide a pump section for a fuel pump that is very resistant to contamination wear.

To achieve the foregoing objects, the present invention is a wear resistant fuel pump for a vehicle including a pump section having a rotatable impeller and a plurality of plates disposed axially adjacent to and cooperating with the impeller to pump fuel therethrough. The wear resistant fuel pump also includes a motor section disposed adjacent the pump section and having a motor to rotate the impeller. The wear resistant fuel pump further includes an outlet section disposed adjacent the motor section to allow pumped fuel to exit therethrough. The impeller is made of a first compound and the plates are made of a second compound having an abrasion wear resistance on a surface thereof that improves abrasion wear characteristics therebetween.

One advantage of the present invention is that a wear resistant fuel pump is provided for a vehicle. Another advantage of the present invention is that the wear resistant fuel pump has plates made from a powdered metal with a steam oxide wear surface and a plastic impeller highly filled with ceramic chips. Yet another advantage of the present invention is that the wear resistant fuel pump improves fuel pump performance and durability in abrasive contaminant environments.

Other objects, features, and advantages of the present invention will be readily appreciated, as the same becomes better understood, after reading the subsequent description taken in conjunction with the accompanying drawings.

DESCRIPTION OF THE PREFERRED EMBODIMENT

Figure 1:
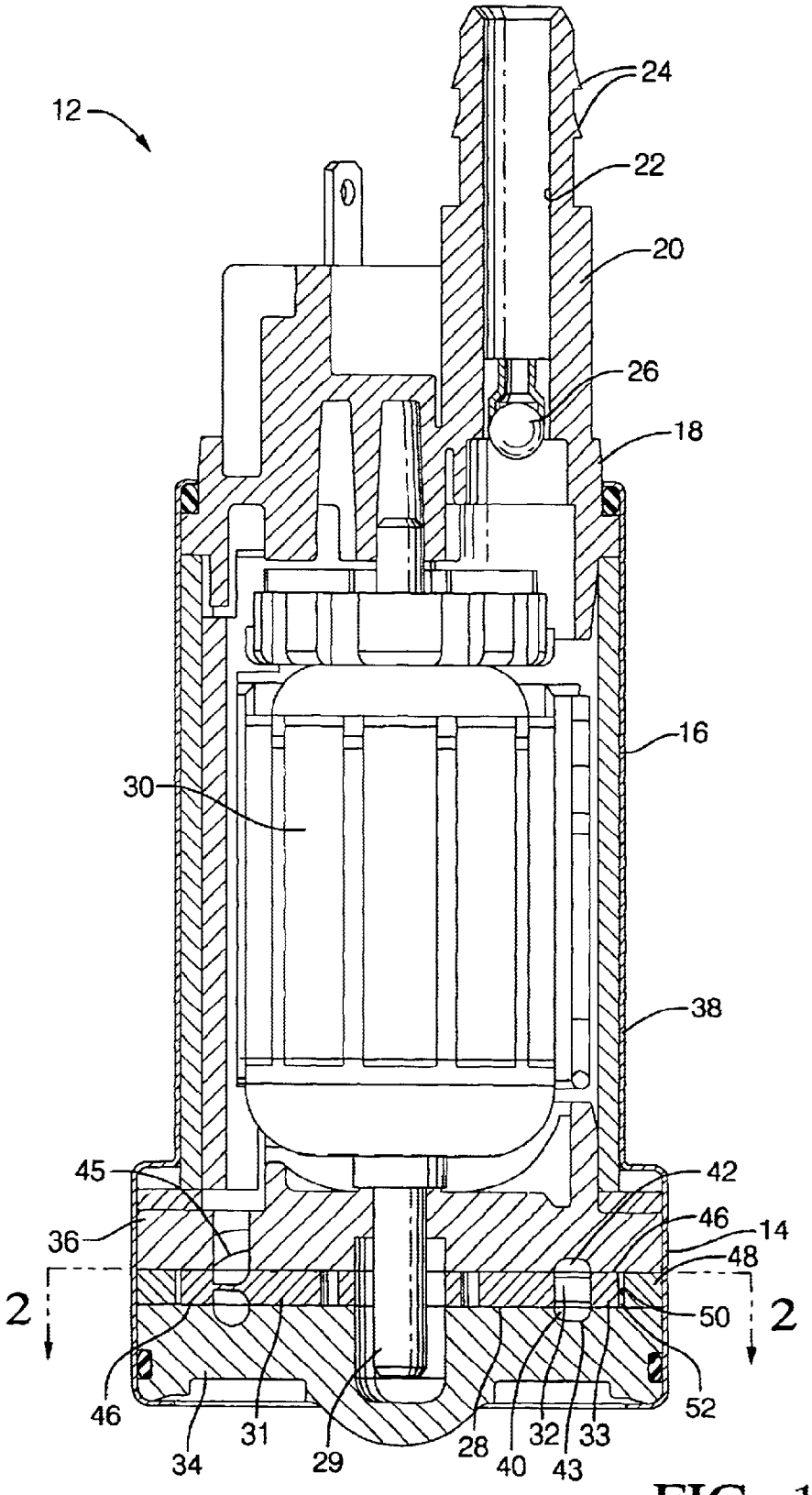
FIG. 1 is a fragmentary elevational view of a wear resistant fuel pump, according to the present invention.
Figure 2:
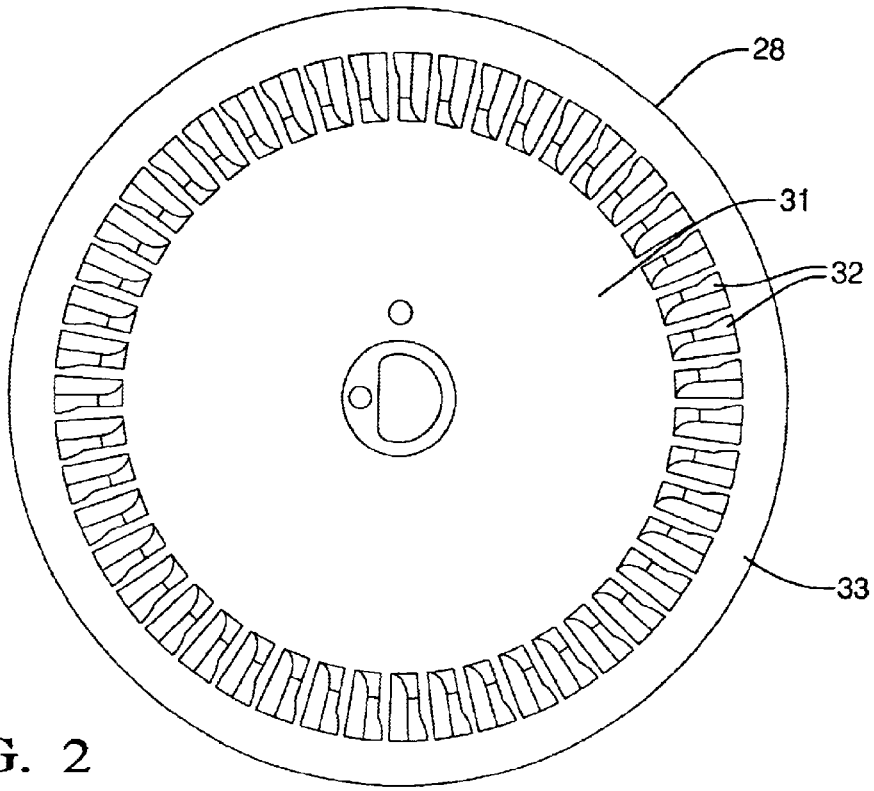
FIG. 2 is a sectional view taken along line 2—2 of FIG. 1.

Referring to the drawings and in particular FIGS. 1 and 2, one embodiment of a wear resistant fuel pump 12, according to the present invention, is shown for a vehicle (not shown). The wear resistant fuel pump 12 includes a pump section 14 at one axial end, a motor section 16 adjacent the pump section 14 and an outlet section 18 adjacent the motor section 16 at the other axial end. As known in the art, fuel enters the pump section 14, which is rotated by the motor section 16, and is pumped past the motor section 16 to the outlet section 18. The outlet section 18 has an outlet member 20 extending axially with a passageway 22 extending axially therethrough. The outlet member 20 also has a plurality of projections or barbs 24 extending radially outwardly for attachment to a conduit (not shown). The outlet member 20 also includes a check valve 26 disposed in the passageway 22. It should be appreciated that the fuel flowing to the outlet section 18 flows into the outlet member 20 and through the passageway 22 and check valve 26 when open to the conduit. It should also be appreciated that, except for the pump section 14, the fuel pump 12 is conventional and known in the art.

Referring to FIGS. 1 and 2, the pump section 14 includes an impeller 28 mounted to a rotatable shaft 29 of a motor 30 of the motor section 16 for rotation therewith. The impeller 28 is generally planar and circular in shape. The impeller 28 has a hub portion 31 attached to the shaft 29 by suitable means (not shown). The impeller 28 also has a plurality of blade tips 32 extending radially from the hub portion 31 and disposed circumferentially thereabout. The impeller 28 has a peripheral ring portion 33 extending radially from the blade tips 32 to shroud the blade tips 32. The impeller 28 is made of a first compound to be described.

The pump section 14 also includes an inlet plate 34 disposed axially on one side of the impeller 28 and an outlet plate 36 disposed axially on the other side of the impeller 28. The inlet plate 34 and outlet plate 36 are generally planar and circular in shape. The inlet plate 34 and outlet plate 36 are made of a second compound to be described. The inlet plate 34 and outlet plate 36 are enclosed by a housing 38 and fixed thereto. The inlet plate 34 and outlet plate 36 have an inlet or first recess 40 and an outlet or second recess 42, respectively, located axially opposite the blade tips 32 adjacent to the peripheral ring portion 33 to form a flow channel 43 for a function to be described. The recesses 40 and 42 are annular and allow fuel to flow therethrough from an inlet port (not shown) to an outlet port 45 of the pump section 14. The peripheral ring portion 33 of the impeller 28 forms an outside diameter (OD) sealing surface 46 on both axial sides thereof with the inlet plate 34 and outlet plate 36. It should be appreciated that the impeller 28 rotates relative to the inlet plate 34 and outlet plate 36 and the inlet and outlet plates 34 and 36 are stationary.

The pump section 14 also includes a spacer ring 48 disposed axially between the inlet plate 34 and outlet plate 36 and spaced radially from the impeller 28. The spacer ring 48 is fixed to the housing 38 and is stationary relative to the impeller 28. The spacer ring 48 is generally planar and circular in shape. The spacer ring 48 has an inner diameter 50 that is spaced from the outside diameter of the peripheral portion 33 of the impeller to form an outside diameter (OD) cavity 52 between the inner diameter 50 of the spacer ring 48 and an outside diameter of the peripheral ring portion 33 of the impeller 28. It should be appreciated that fluid flows through both the inlet plate recess 40 and the outlet plate recess 42 and enters both recesses 40 and 42 at the inlet port region and exits out the outlet port region.

Figure 3:
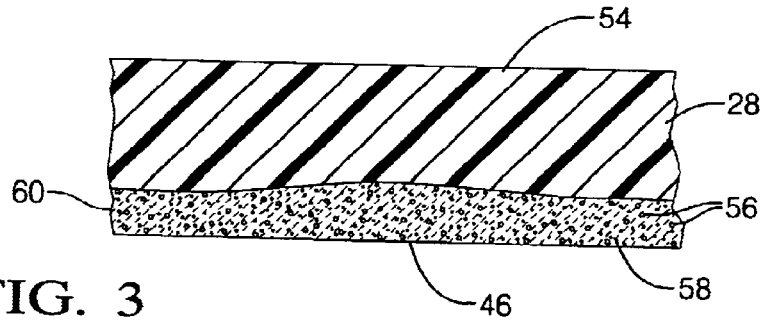
FIG. 3 is a fragmentary elevational view of a first portion of the wear resistant fuel pump of FIG. 1.

The impeller 28 is made of a first compound having an abrasive wear resistance. The first compound is a plastic base resin material 54 and an abrasion wear resistant filler material 56 as illustrated in FIG. 3. The base resin material 54 is a plastic material such as phenolic and the filler material 56 is an abrasion wear resistant material, for example Zirconium Oxide, $R_c$=71, silica, ceramic chips or spheres, that has a hardness equal to or greater than the hardness of an abrasive contaminant, for example quartz, $R_c$=64, ingested by the fuel pump 12 during operation and causing abrasive wear. The concentration and size of the filler material 56 is selected such as zirconium oxide with a 40 micron typical particle size. The filler material 56 is in a crushed or beaded form. The filler material 56 is bonded together with a binder 58 such as a low molecular weight phenolic liquid or powdered resin to form a micro-porous insert 60. The binder 58 also produces a good bond between the base resin material 54 and the filler material 56 and combine attributes of impact resistance to prevent chipping and cross-link density to improve tear resistance. The low molecular weight of the resin for the binder 58 is ductile and formable at molding temperatures, which allows the insert 60 to comply with the shape of a mold 62 to be described. It should be appreciated that the impeller 28 can be molded with a high level of filler material 56, which allows complex shapes for the impeller 28 to be produced. It should also be appreciated that the filler material 56 is harder than the contamination so that the impeller 28 is protected from wear by the ceramic filler material.

A plastic molding process, injection or compression, is used to make the impeller 28 with a high content of filler material 56 either at the surface or throughout the base resin material 54. The highly filled surface is micro-porous and allows the base resin material 54 to penetrate and fill the voids within the micro-porous insert 60 and establish a bond with particles of the filler material 56. The insert 60 has adequate porosity to allow the plastic base resin material 54 to flow through and be of a proper material or coating to form a bond with the base resin material 54. For example, the insert 60 may be made of filler material 56 in the form of beads of $ZrO_2$ coated with the binder 58 of low molecular weight phenolic resin. The insert 60 could be pressed into a disc of proper geometry to fit a mold cavity of a mold (not shown). The bead size of the filler material 56, coating material, pressure and temperature is optimized to create the desired porosity of the insert 60. It should be appreciated that small holes could be pressed into the insert 60 to improve material flow through the surface.

The compound may be modified by increasing the cross-link density to harden the base resin material 54 and improve its tear strength. Eight formulations have been developed to investigate the effects of filler material types, degree of cure and impact strength modifiers on abrasion resistance. The results and formulations are shown in Table 1 below.

TABLE 1

Composition and Abrasion Properties of Phenolic Compounds Formulations, Percent by Weight

| Ingredients (wt. %) | PR-1 | PR-2 | 1 | 2 | 3 | 4 | 5 | 6 |
|---|---|---|---|---|---|---|---|---|
| Phenolic Binder Plenco 12390 | 5 | 5 | 10 | 10 | 10 | 10 | 10 | 10 |
| Zirconium Oxide | 95 | — | 90 | — | — | — | 88 | 87 |
| Novakup 200 Malvern Microcrystalline Silica, Platy, Treated | — | 95 | — | 90 | — | — | — | — |
| Zeospheres G-800 3M Ceramic Spheres | — | — | — | — | 90 | 89 | — | — |
| Paphen PHGF Phenoxy Resin Phenoxy Specialties Co. | — | — | — | — | 0 | — | 2 | 2 |
| Hexa, Plenco Hexamethylene Tetraamine, Curing agent | — | — | — | — | — | 1 | — | 1 |
| Degree of Abrasion (g) | 0.404 | 0.365 | 0.293 | 2.328 | 2.275 | 0.463 | 0.219 | 0.046 |

The above formulations are examples of compositions of the compound that would improve abrasion resistance and enhance durability of fuel pump parts. Without increased cure and without the presence of impact strength modifiers, zirconia is superior to silica or ceramic spheres in abrasion resistance. Significant improvements in abrasion resistance are observed when the degree of cure is increased by adding 1% additional Hexa (compare formulation 3 & 4). Comparing formulation PR-1 and 5, it should be noted that the addition of an impact strength modifier, Paphen PHGF, also improves abrasion resistance, even for a formulation that already has appreciable abrasion resistance. Addition of both curative and impact modifiers lead to much improved abrasion resistance as seen in the case of formulation 6.

Figure 4:
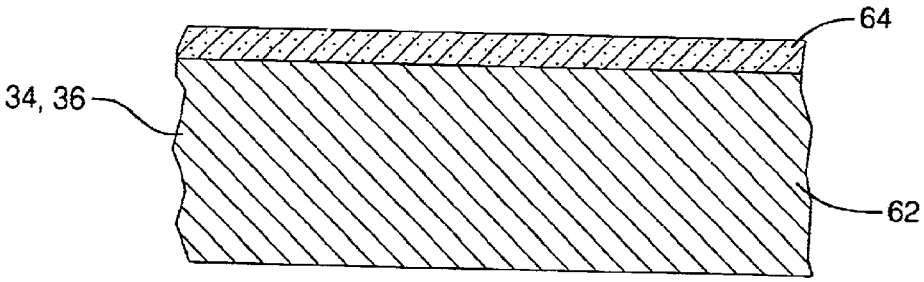
FIG. 4 is a fragmentary elevational view of a second portion of the wear resistant fuel pump of FIG. 1.

Referring to FIG. 4, the plates 34 and 36 are made from a second compound having an abrasive wear resistance. The second compound is a powdered metal 62 with a steam oxide wear surface 64. The powdered metal 62 may be a metal material such as steel, or steel-based material. The powdered metal 62 is sintered at high temperatures and lapped. The sintered metal is treated with a steam oxide process that forms a high oxide film or surface 64 on the plates 34 and 36 that protect the plates 34 and 36 from contamination wear. It should be appreciated that using steam oxide pressed metal plates 34 and 36 and a ceramic filled impeller 28 in conjunction with each other produces a pump section 14 that is very resistant to contamination wear. It should also be appreciated that the steam oxide process is conventional and known in the art.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A wear resistant fuel pump for a vehicle comprising:

a pump section having a rotatable impeller and a plurality of plates disposed axially adjacent to and cooperating with said impeller to pump fuel therethrough;

a motor section disposed adjacent said pump section and having a motor to rotate said impeller;

an outlet section disposed adjacent said motor section to allow pumped fuel to exit therethrough; and said impeller being made of a first compound and said plates being made of a second compound different from said first compound and having an abrasion wear resistance on a surface thereof that improves abrasion wear characteristics therebetween.

2. A wear resistant fuel pump as set forth in claim 1 wherein said second compound comprises a powdered metal material having a steam oxide wear surface.

3. A wear resistant fuel pump as set forth in claim 2 wherein said powdered metal material comprises steel.

4. A wear resistant fuel pump as set forth in claim 1 wherein said first compound comprises a base resin material and a filler rich material.

5. A wear resistant fuel pump as set forth in claim 4 wherein said first compound includes a binder to bind said filler material together to form a porous insert.

6. A wear resistant fuel pump as set forth in claim 5 wherein said binder has a low molecular weight.

7. A wear resistant fuel pump as set forth in claim 4 wherein said base resin material is made of phenolic resin.

8. A wear resistant fuel pump as set forth in claim 4 wherein said filler material has a hardness greater than 65 Rc.

9. A wear resistant fuel pump as set forth in claim 4 wherein said filler material is in the form of chips.

10. A wear resistant fuel pump as set forth in claim 4 wherein said filler material is an abrasion wear resistant material comprising ceramic.

11. A wear resistant fuel pump as set forth in claim 4 wherein said filler material is zirconium oxide with a 40 micron typical particle size.

12. A wear resistant fuel pump for a vehicle comprising:

a housing;

a pump section disposed in said housing having a rotatable impeller and an inner plate and an outer plate disposed axially adjacent to and cooperating with said impeller to pump fuel therethrough;

a motor section disposed in said housing adjacent said pump section and having a motor to rotate said impeller;

an outlet section disposed in said housing adjacent said motor section to allow pumped fuel to exit therethrough; and said impeller being made of a first compound and said inner plate and said outer plate being made of a second compound different from said first compound and having an abrasion wear resistance on a surface thereof that improves abrasion wear characteristics therebetween.

13. A wear resistant fuel pump as set forth in claim 12 wherein said second compound comprises a powdered metal material having a steam oxide wear surface.

14. A wear resistant fuel pump as set forth in claim 13 wherein said powdered metal material comprises steel.

15. A wear resistant fuel pump as set forth in claim 12 wherein said first compound comprises a base resin material and a filler material.

16. A wear resistant fuel pump as set forth in claim 15 wherein said filler material is in the form of chips.

17. A wear resistant fuel pump as set forth in claim 15 wherein said filler material is an abrasion wear resistant material comprising ceramic.

18. A wear resistant fuel pump as set forth in claim 15 wherein said base resin material is made of phenolic resin.

19. A wear resistant fuel pump as set forth in claim 15 wherein said first compound includes a binder to bind said filler material together to form a porous insert.

20. A wear resistant fuel pump for a vehicle comprising:

a housing;

a pump section disposed in said housing having a rotatable impeller and an inner plate and an outer plate disposed axially adjacent to and cooperating with said impeller to pump fuel therethrough;

a motor section disposed in said housing adjacent said pump section and having a motor to rotate said impeller;

an outlet section disposed in said housing adjacent said motor section to allow pumped fuel to exit therethrough; and said impeller being made of a plastic material filled with ceramic chips and said inner plate and said outer plate being made of a powdered metal with a steam oxide wear surface that improves abrasion wear characteristics therebetween.

* * * * *